US005678593A

United States Patent [19]

Lockhart

[11] Patent Number: 5,678,593

[45] Date of Patent: Oct. 21, 1997

[54] DETERGENT MIXING APPARATUS

[76] Inventor: Barton Lockhart, 905 Red Oak La., Corsicana, Tex. 75110

[21] Appl. No.: 590,765

[22] Filed: Jan. 24, 1996

Related U.S. Application Data

[63] Continuation-in-part of Ser. No. 451,767, May 26, 1995, abandoned, which is a continuation-in-part of Ser. No. 249,961, May 27, 1994, Pat. No. 5,439,020.

[51] Int. Cl.[6] ..... B01F 5/04

[52] U.S. Cl. ..... 137/268; 137/889; 422/281

[58] Field of Search ..... 137/268, 889; 422/261, 281

[56] References Cited

U.S. PATENT DOCUMENTS

| | | | |
|---|---|---|---|
| 1,947,994 | 2/1934 | Larson . | |
| 3,447,505 | 6/1969 | Wagner . | |
| 3,459,334 | 8/1969 | Evans . | |
| 3,595,268 | 7/1971 | Archer . | |
| 3,976,087 | 8/1976 | Bolton et al. . | |
| 4,020,865 | 5/1977 | Moffat et al. | 137/268 |
| 4,171,710 | 10/1979 | Boynton et al. . | |
| 5,230,368 | 7/1993 | Berfield | 137/889 |
| 5,439,020 | 8/1995 | Lockhart | 137/268 X |

FOREIGN PATENT DOCUMENTS 1505431 8/1969 Germany .

*Primary Examiner*—Kevin Lee
*Attorney, Agent, or Firm*—Stephen R. Greiner

[57] ABSTRACT

A detergent mixing apparatus for use with a pressurized water source. The apparatus includes at least one mixing tank and a pair of liquid chemical supply containers each accommodating a liquid chemical composition. A water supply conduit connects a pressurized water source with the mixing tank. A pair of venturi chambers are disposed within the water supply conduit and are arranged for parallel flow. Each of the venturi chambers includes a suction port in fluid communication, respectively, with one of the liquid chemical supply containers so as to drawing the liquid chemical composition from each chemical supply container as pressurized water passes through the venturi chambers thus entraining the liquid chemical compositions in the water. A float-actuated control valve is operably connected to the water supply conduit for terminating the flow of water and entrained liquid chemical compositions through the water supply conduit when the liquid level in the mixing tank reaches a predetermined height.

20 Claims, 3 Drawing Sheets

DETERGENT MIXING APPARATUS

This application is a continuation-in-part of the application, Ser. No. 08/451,767, filed May 26, 1995, and now abandoned, which, in turn, was a continuation-in-part of the application, Ser. No. 08/249,961, filed May 27, 1994, which issued as U.S. Pat. No. 5,439,020 on Aug. 8, 1995.

FIELD OF THE INVENTION

The present invention relates generally to fluid handling systems having plural tanks or compartments connected for serial flow, and, more particularly, to a system for mixing and diluting detergent components utilized in spray washing equipment.

BACKGROUND OF THE INVENTION

Detergent products employed in automated car washes usually include two broad types of chemical products—inorganic alkalinity builders and organic surfactants. These detergents are typically delivered to car wash operators, ready to use, in concentrated liquid and powdered forms. Various difficulties, however, limit the concentration at which the detergents can be distributed and negatively influence the profit margin of capital-intensive, car washing businesses.

Because of well-known instability problems, liquid detergents must often be diluted with water and enhanced with costly stabilizing agents to prevent their breakdown during transit and subsequent storage prior to use. The disadvantages associated with increasing the fraction of water in a given detergent mixture are many, and associated manufacturing, packaging, transporting, and handling costs normally rise in proportion to the amount of water contained therein. Of course, highly concentrated liquid surfactants, absent the usual inorganic compounds, can be procured, but such are generally considered to be less effective as cleaning agents.

Detergents, delivered in powdered form, typically include a mix of finely divided phosphates, silicates and carbonates as well as a modest amount of evenly distributed liquid surfactant. Generally, the surfactant concentration in the resulting detergent composition is limited to approximately 15 percent by weight. Excess amounts of the surfactant result in powders wherein the individual granules tend to adhere to one another and fail to flow through state-of-the-art blending and dispensing equipment.

Dispensing a premixed, powdered detergent in a modern car wash is especially problematic. Hand measurement of the detergent by inexperienced workmen is time consuming and prone to mistake. Detergent over-concentration can result in significant waste when separation of the several detergent components in the solution holding tank occurs. Automatic dispensing equipment, such as that disclosed in U.S. Pat. No. 4,020,865, on the other hand, frequently yields detergents which lack effective concentrations of intended constituents due to their relative variations in water solubilities. Further, prolonged and unchecked dampness can lead to consolidation of the powdered material so as to completely prevent admission of the detergent into the car wash fluid stream through automated means.

SUMMARY OF THE INVENTION

In view of the above-mentioned problems, it is the principal object of the instant invention to provide an improved detergent mixing apparatus wherein discrete, highly-concentrated inorganic and organic compounds (replacing the heretofore standard liquid and powdered detergent mixtures of relatively dilute form) can be mixed in the proper proportion for immediate discharge into a car wash spraying system. These detergent chemicals, then, can be supplied as economical, highly-concentrated powders and liquids in stable form.

It is another object of the invention to provide a detergent mixing apparatus, for use with an external source of pressurized water, with a venturi assembly for drawing a number of discrete liquid chemicals into the flow of pressurized water passing through the assembly, the water flow being regulated by a float-actuated valve capable of terminating the flow of pressurized water when the liquid level in a tank receiving the water and entrained detergent chemicals reaches a predetermined elevation.

It is a further object of the present invention to provide a detergent mixing apparatus with a plurality of venturi assemblies, each having a common liquid feed from a single chemical supply container as well as additional and segregated liquid feeds so as to produce liquid cleaning agents having different washing characteristics and abilities.

It is an additional object of the instant invention to provide a detergent mixing apparatus with an improved venturi assembly which retains detergent constituents in a segregated condition until such are drawn into a diluting stream of water so as to prevent the formation of equipment-blocking gels or chemical precipitates which could otherwise develop if mixing were to occur while the detergent constituents were in a highly-concentrated form.

It is another object of the invention to provide a detergent mixing apparatus of the type described wherein one of the liquid chemical supply containers is a dissolution tank for dissolving powdered chemicals, such as inorganic alkalinity builders, in water. A float-actuated control valve restores the liquid level in the dissolution tank to a predetermined elevation by the addition of water whenever sufficient quantities of liquid have been drawn therefrom.

It is a further object of the invention to provide a detergent mixing apparatus with a dissolution tank with means for stirring the contents thereof to expedite the dissolution in water of powdered, granular or other solid forms of chemicals placed therein.

It is an object of the invention to provide improved elements and arrangements thereof in a detergent mixing apparatus for the purposes described which is inexpensive, dependable and fully effective in accomplishing its intended purposes.

Briefly, the detergent mixing apparatus in accordance with this invention achieves many of its intended objects by featuring a mixing tank and a pair of liquid chemical supply containers. A water supply conduit connects a pressurized water source with the mixing tank. A pair of venturi chambers are disposed within the water supply conduit and are arranged for parallel flow. Each of the venturi chambers includes a suction port in fluid communication, respectively, with one of the liquid chemical supply containers so as to draw the liquid chemical composition from each of the chemical supply containers as pressurized water passes through the venturi chambers. A float-actuated control valve is operably connected to the water supply conduit for terminating the flow of water, and entrained chemical compositions therein, through the water supply conduit when the liquid level in the mixing tank reaches a predetermined height.

The foregoing and other objects, features and advantages of the present invention will become readily apparent upon further review of the following detailed description of the preferred embodiments as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
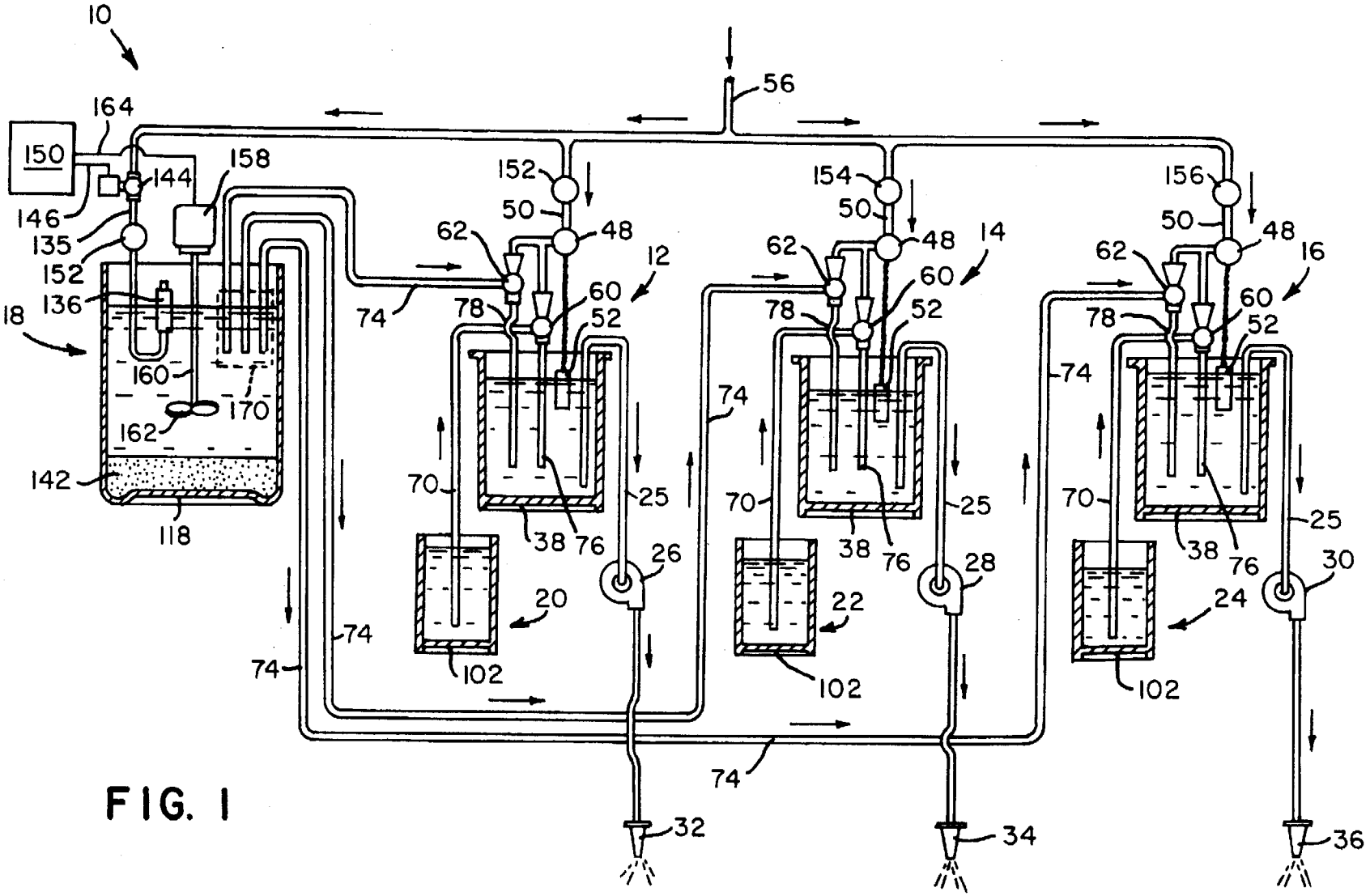
FIG. 1 is a schematic view of a detergent mixing apparatus in accordance with the present invention.

Referring to the drawings, the invention will first be explained in connection with the schematic illustration, FIG. 1, of one embodiment thereof. There will then be described the constructional details of the preferred forms of the invention in FIGS. 2–7. Where alternative structures are described, it should be understood that such may be readily substituted for a corresponding structure shown in FIG. 1 to construct an operative apparatus.

Referring now to FIG. 1, a detergent mixing apparatus in accordance with the present invention is illustrated generally at 10. The apparatus 10 preferably includes three mixing tanks 12, 14 and 16 for producing dilute detergent solutions having predetermined proportions of two or more detergent constituents. Each of the mixing tanks 12, 14 and 16 receives one detergent constituent from a dissolution tank 18 adapted to dissolve finely-divided inorganic solids in water to form a highly-concentrated liquid. The mixing tanks 12, 14 and 16 are also supplied with liquid surfactants or other detergent additives from three, liquid chemical supply containers 20, 22 and 24. Dilute detergent solutions formed in the mixing tanks 12, 14 and 16 may be drawn, respectively, therefrom by pumps 26, 28 and 30 for sprayed discharge at nozzles 32, 34 and 36.

Figure 2:
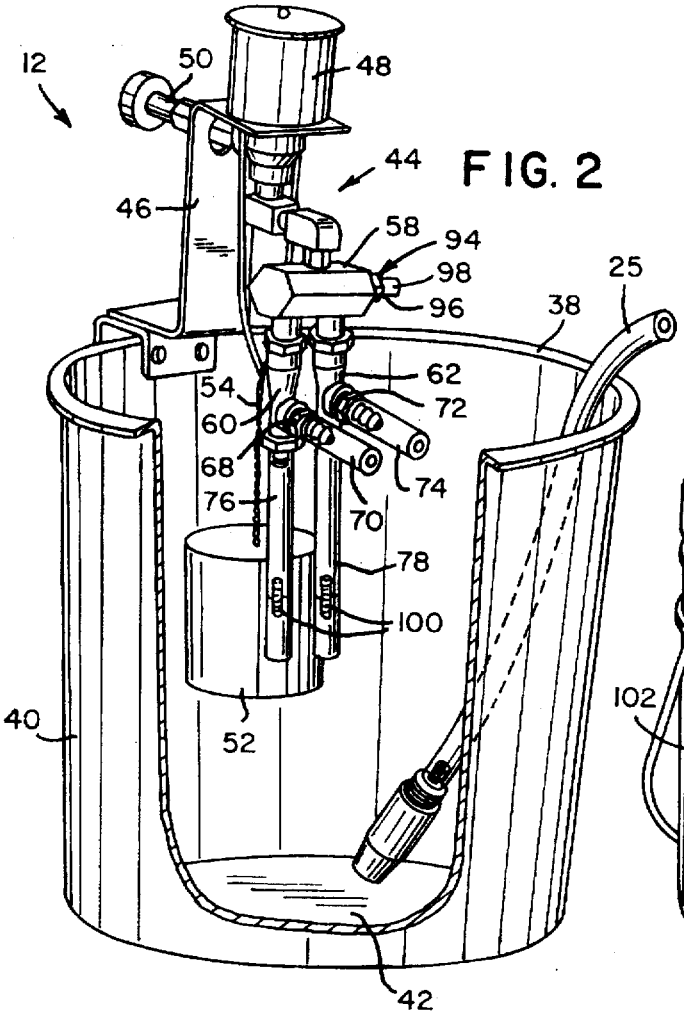
FIG. 2 is a perspective view of the venturi assembly carried by a mixing tank having portions broken away.

The mixing tank 12, shown in FIG. 2, is representative of the structures the mixing tanks 14 and 16. Therefore, each of the mixing tanks 12, 14 and 16 may be understood to comprise an open-topped bucket 38 of approximately 5 gallons (21 liters) capacity. The buckets 38 are preferably cylindrical in shape and each include an upright side wall 40 integrally secured to a circular base 42. A venturi assembly 44 is mounted by a support bracket 46 on each of the bucket side walls 40 for regulating the flow of liquid into the buckets 38.

The venturi assemblies 44 each include a valve 48 for controlling the flow of pressurized water from an inlet conduit 50 into the buckets 38. The valve 48 is actuated by the motion of a buoyant float 52 suspended within a bucket 38 by a chain 54. During use, the valve 48 closes at a point when the tension exerted by the float 52 through the chain 54 releases spring tension in the valve 48. Likewise, the valve 48 opens when a lowering of the liquid level causes the float 52 to exert a sufficiently increased tension through the chain 54. Once opened, the valve 48 permits pressurized water from a municipal source 56 to flow through the inlet conduit 50 into a manifold 58 in fluid communication with the valve 48.

Figure 4:
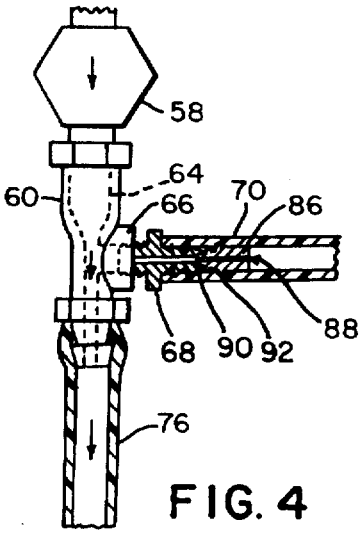
FIG. 4 is a partial cross-sectional view of a preferred venturi assembly.

The manifold 58 carries a pair of eductors 60 and 62 each having an internal venturi chamber 64, seen in FIG. 4, defining a flow passage from the top to the bottom thereof. A suction port 66 in one side of each eductor 60 and 62 provides lateral access to the venturi chamber 64. By means of a coupler 68 threaded into the suction port 66 of eductor 60, a fluid transfer conduit 70 extending from liquid chemical supply container 20 is placed fluid communication with the venturi assembly 44. With a similar coupler 72 in the eductor 62, one of the parallel fluid transfer conduits 74 extending from the dissolution tank 18 is placed in fluid communication with the venturi assembly 44.

As pressurized water flows through the eductors 60 and 62, a partial vacuum is created within their venturi chambers which draws a detergent constituent from the dissolution tank 18 into eductor 62 and another detergent constituent from one of the liquid chemical supply containers as at 20 into eductor 60. Once entrained in the water flow stream, the detergent constituents flow, respectively, from the eductors 60 and 62 into discharge conduits 76 and 78 for discharge into the buckets 38.

Turbulent flow in the buckets 38 during discharge from the conduits 76 and 78 has been found to be sufficient in adequately mixing the detergent constituents from the dissolution tank 18 and a liquid chemical supply container like 20. Thus, the detergent liquid formed in the mixing tanks 12, 14 and 16 is complete, stable and ready for use in spray washing equipment.

Figure 5:
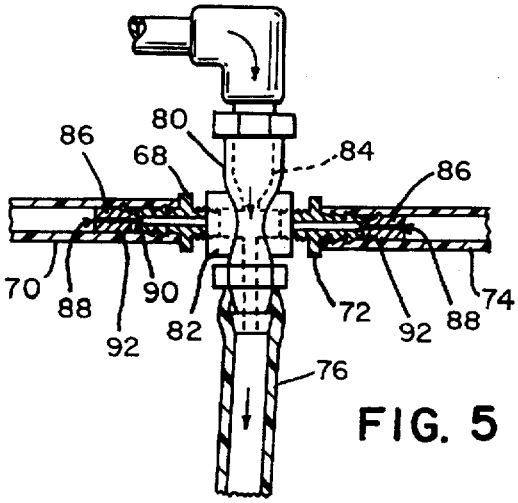
FIG. 5 is a partial cross-sectional view of an alternative venturi assembly.

In FIG. 5, an alternative eductor construction is illustrated at 80 which could be employed in place of either, or both, of the eductors 60 and 62. As shown, coupler 68 is secured to one of a pair of suction ports 82 on opposite sides of the venturi chamber 84. Coupler 72 is secured to the remaining suction port 82. In this arrangement, detergent constituents drawn from conduits 70 and 74 do not intermix until they have entered the venturi chamber 84.

The rate at which detergent constituents are drawn into the eductors 60, 62 and/or 80 is controlled by metering inserts 86 each having a relatively-small, central orifice 88. To secure the inserts 86 in place, the inlet opening 90 of each of the couplers 68 and 72 is sized to partially receive a tapered end portion of an insert 86. A series of annular rings 92, projecting outwardly from the tapered end portion of each insert 86, aid in positioning each insert within an opening 90. After being secured to the couplers 68 and 72, a portion of each insert 86 protrudes therefrom and permits each insert to be grasped and withdrawn from the opening 90 for replacement or cleaning.

It should be noted that the size of the orifice 88 in each metering insert 86 may be varied to adjust the relative proportions of the detergent constituents collected in each of the mixing tanks 12, 14 and 16. Establishing the proper orifice size, however, often requires patience. To this end, the suction pressure afforded by the eductors 60 and 62, the viscosities of the detergent constituents being delivered thereto and the relative proportions of those constituents desired to be collected in the mixing tanks must all be considered on a case-by-case basis.

To prevent the unintended siphoning of liquid through the venturi assemblies 44, an antisiphon valve 94 is provided to each manifold S8. The antisiphon valve 94 includes an externally threaded body 96, for threaded fastening to one end of a manifold 58, and an air passageway 98 adapted to open and admit air to the manifold 58 when the fluid pressure within the manifold reaches a predetermined minimum. This minimum pressure is typically reached when the upstream, float-controlled valve 48 closes and is preferably somewhat greater than the hydrostatic head of the liquid in the manifold 58 at that time.

Once opened, the antisiphon valve 94 operates to evacuate the manifold 58 and eductors 60 and 62 with their contents draining into a bucket 38 through the discharge conduits 76 and 78. Thus, the possibility of liquid siphoning out of the mixing tanks 12, 14 and 16 is precluded. The possibility of liquid siphoning from the dissolution tank 18 to an associated liquid chemical supply container 20, 22 or 24 through the transfer conduits 70 and 74, or vice versa, is also precluded.

It is desirable that cavitation not occur in the drained venturi chambers 64 and/or 84 upon opening of the float-controlled valve 48 as such may cause the uneven withdrawal of detergent constituents from the dissolution tank 18 and liquid chemical supply containers 20, 22 and 24. Therefore, a tubular flow restrictor 100 is frictionally engaged within each of the discharge conduits 76 and 78. As shown, each flow restrictor 100 comprises a conventional tubing coupler having a restricted flow passage; however, any other suitable device may be employed to cause a liquid backup to fill the discharge conduits 76 and 78, venturi chambers 64 and/or 84, and manifold 58. This liquid backup prevents cavitation and permits the eductors 60, 62 and/or 80 to evenly draw detergent constituents from the dissolution tank 18 and liquid chemical supply containers 20, 22 and 24 almost immediately after the valve 48 is opened.

Figure 3:
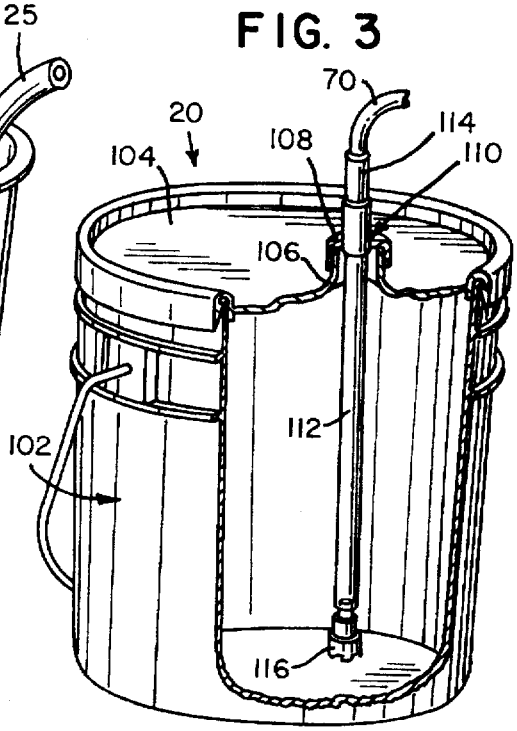
FIG. 3 is a perspective view of a liquid chemical supply container having portions broken away.

FIG. 3 illustrates a typical, liquid chemical supply container 20. As shown, the container 20 comprises a plastic bucket 102 of approximately 6 gallons (25 liters) capacity having a removable cover 104. The cover 104 is provided with an upwardly projecting spout 106 for access to the container interior. To the top of the spout 106 is threadably secured a cap 108 having a central opening 110 for the snug passage of a rigid outlet tube 112 whose top end may be secured to the transfer conduit 70. Adjacent the top of the tube 112, an annular ring 114, having an outer diameter greater than that of the central opening 110, is provided to retain the bottom of the tube 112 at a fixed distance above the bottom of the bucket 102.

A conventional foot valve 116 is inserted in the bottom of the tube 112 and is also suspended by the tube 112 above the bottom of the bucket 102. The foot valve 116 includes an internal screen and check valve (both not shown). The screen prevents debris from flowing to the metering inserts 86 and potentially blocking them whereas the check valve eliminates the possibility of liquid siphoning through the tube 112 into the bucket 102.

Figure 6:
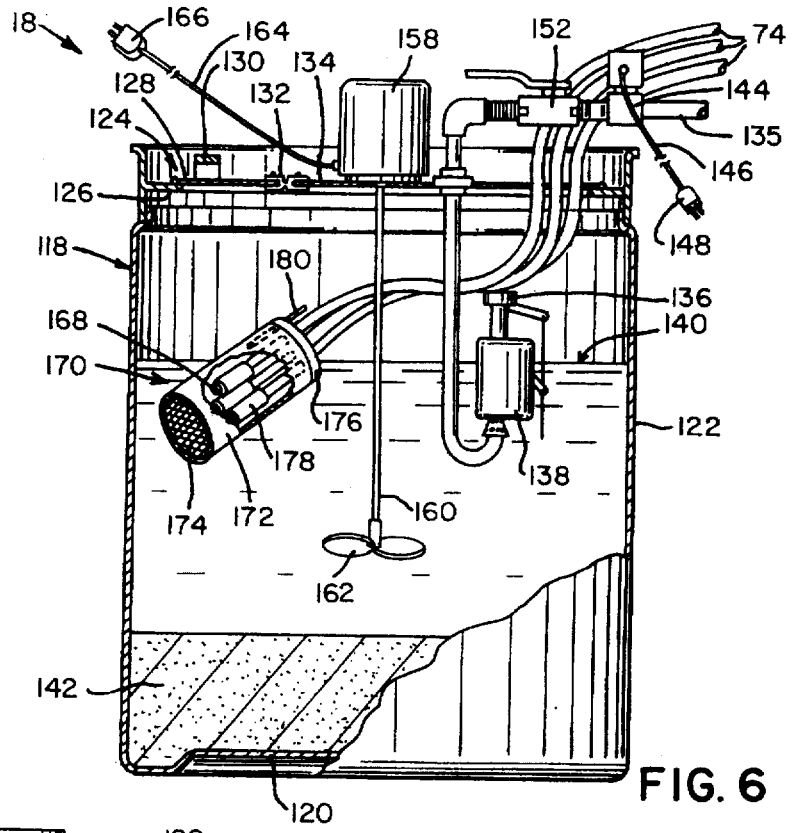
FIG. 6 is a side elevational view of the preferred dissolution tank of the invention with portions thereof broken away to reveal structural details.

Referring now to FIG. 6, the dissolution tank 18 may be seen in detail. Preferably, the tank 18 comprises a barrel 118 having a 55 gallon (230 liter) capacity. The barrel 118 includes a circular base 120 having an upstanding, side wall 122 integrally secured thereto. The barrel 118 is closed at its top by a removable and hinged lid 124. The lid 124 is supported within upper end of the barrel 118 by an annular shoulder 126 projecting inwardly from the side wall 122.

Although preferably provided with a cylindrical configuration, the barrel 118 may be formed in any desired shape to better allow it to conform to the space requirements of a particular installation. However, as relatively dense solid material will be disposed upon the bottom of the barrel 118 for dissolution in water, it is desirable to maximize, when practicable, the area of contact between the solid and liquids. Thus, by increasing the cross-sectional area or "footprint" of the barrel 118, the rate of dissolution of solid material in water may be increased proportionately.

Like the buckets 38 and 102, the barrel 118 may be fabricated from any material suitable for storing or transporting liquid chemical compositions. Molded polyethylene, for instance, has been found to be satisfactory as it is resistant to both the action of the usual detergent components and inadvertent blows due to mishandling. Polyethylene has the added benefit of being somewhat translucent when molded in thicknesses suitable for use in buckets and barrels. Thus, an observer may gauge the relative levels of solid and liquid materials within such a bucket or barrel from a remote distance.

The lid 124 closes the opening in the upper end of the barrel 118. The lid 124 includes a door portion 128 having a handle 130, for access into the barrel interior, attached by a resilient hinge 132 to a stationary portion 134 adapted to rest upon the annular shoulder 126 at all times during use. The lid 124 need not seal the opening in the barrel 118 so as to prevent the admission of air and need not be provided with any particular shape; however, in the preferred embodiment a circular shape conforms best to the outline of the barrel 118.

The stationary portion 134 supports a valve 136 having a cooperating float 138 for admitting pressurized water from water inlet 135, into the barrel 118. When the fluid level 140 falls below a predetermined elevation, the float 138 opens the valve 136 to admit a fixed quantity of water into the barrel 118. Fresh water entering the barrel 118 dilutes the solution located therein and permits the further dissolution of a granular detergent constituent 142 at the bottom of the barrel.

A pair of serially-arranged valves are provided in the water inlet 135 for regulating water flow into the barrel 118. A solenoid actuated valve 144 is provided in the inlet 135 to allow water flow to the barrel 118 only when the valve 144 receives an electrical current through a lead 146 having a plug 148. The plug 148 is preferably attached to a timer 150, shown schematically in FIG. 1, to provide an electrical current to the valve 144 at set intervals. Additionally, a manually-operated, ball valve 152 is also provided in the inlet 135 for selectively isolating the dissolution tank 18 from the pressurized water source during cleaning, etc. Similar valves 152, 154 and 156 are provided in conduits 50 for isolating the mixing tanks 12, 14 and 16.

An electric motor 158 is positioned atop the stationary portion 134 of the lid 124. The motor 158 drives an elongated shaft 160 extending vertically through the lid 124 into the barrel 118. A propeller 162 is secured to the shaft 160 for gently stirring the contents of the barrel 118.

An electrical lead 164 provides electrical power to the motor 158 for rotating the shaft 160 and propeller 162. A plug 166 at the free end of the lead 164 permits attachment of the lead to an electrical current source such as timer 150. Alternatively, the plug 166 could be inserted into a conventional wall outlet (not shown) for continuous energization of the motor 158.

The timed stirring and water inlet arrangement described above offers three significant benefits. First, a large volume of highly-concentrated or saturated solution containing dissolved detergent constituent 142 can be made during hours when demand for such is low. Second, stirring periods may be limited to save electrical energy and reduce wear on the motor 158. Third, energizing the motor 158 on a timed schedule permits foreign matter in the barrel 118 to settle so that only uncontaminated liquid can be withdrawn therefrom.

Three conduits 74 are shown extending through the stationary portion 134 and into the barrel 118, for transferring liquid from the dissolution tank 18 to the mixing tanks 12, 14 and 16. Each conduit 74 includes a length of flexible plastic tubing having a foot valve 168 secured at its inlet. The foot valves 168 reduce the possibility of liquid siphoning through the conduits 74 into the dissolution tank 18.

A buoyant filter assembly 170 encloses the foot valves 168. The filter assembly 170 includes a cylindrical body 172 having top and bottom ends and an opening between said ends. A fine mesh screen 174 is adhesively secured over the bottom end of the body 172 to prevent debris or suspended detergent material from approaching the foot valves 168. A cap 176 is threadably secured to the top end of the body 172. Because the conduits 74, foot valves 168, body 172 and cap 176, are preferably made from a plastic material that is buoyant in water having a high concentration of dissolved detergent constituent 142, cylindrical weights 178 are secured about the ends of the conduits 74 to partially submerge the assembly 170.

The cap 176 is provided with a number of holes for the snug passage of the transfer conduits 74. An additional hole is provided to snugly receive and retain a vent tube 180 having a screen (not shown) over one of its ends. The vent tube 180 extends a short distance above and below the cap 176 and permits some, but not all, of the air in the assembly 170 to exit from the top of the body 172. Thus, when the assembly 170 is positioned in the barrel 118, it will partially submerge and hold the foot valves 168 at a preferred height below the liquid surface 140.

Figure 7:
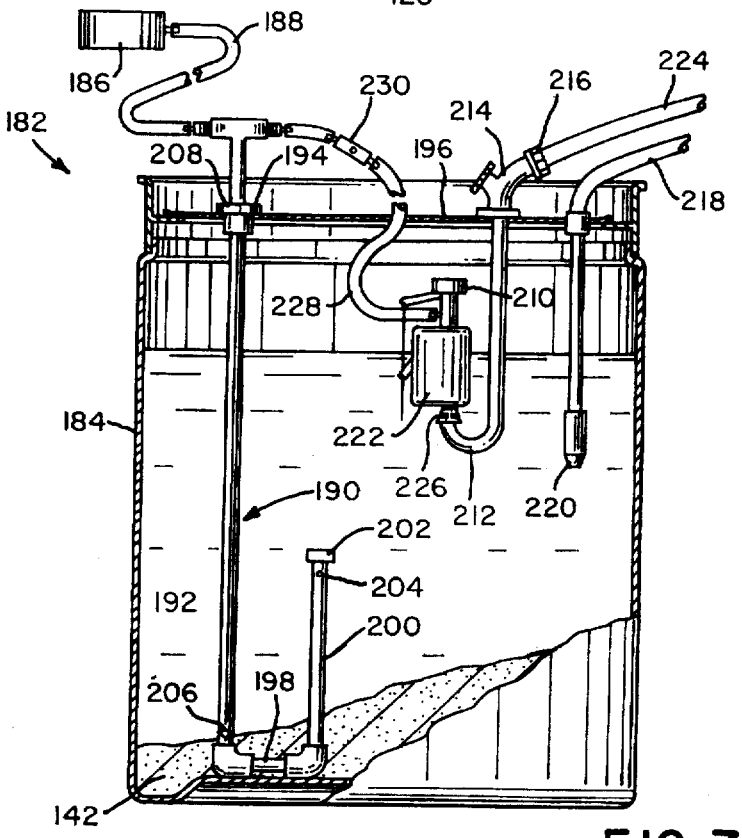
FIG. 7 is a side elevational view of an alternative dissolution tank with portions broken away.

An alternative circulating arrangement for a dissolution tank 182 is illustrated in FIG. 7 wherein a stream of air is provided to a barrel 184 by a diaphragm-type pump 186 to stir the barrel contents. As shown, the air pump 186 is preferably positioned at a location remote from the barrel 184. A flexible tube 188 connects the discharge outlet of the pump 186 to a J-shaped, bubbler tube 190 disposed in the barrel 184.

The J-shaped, bubbler tube 190 includes a principal tubular member 192 which extends downwardly to the bottom of the barrel 184 and is slidably engaged within a stationary slip ring 194 secured to the lid 196. A lateral tubular member 198 extends orthagonally from the bottom of the principal tubular member 192 and is connected to a secondary tubular member 200 which extends partially to the lid 196 in opposed relation to the principal tubular member 192. The top of the secondary tubular member 200 is provided with a cap 202 to prevent the escape of air.

A pair of air vents are provided in the bubbler tube 190. Immediately below the cap 202, the secondary tubular member 200 has a secondary opening 204 on the order of 0.125 inches ( cm) in diameter for air passage. A principal opening 206, having a diameter of 0.25 inch ( cm), is also provided in the bottom of the principal tubular member 192 for air passage.

In normal use, the flow of air from the pump 186 is regulated so that air is only discharged from the principal opening 206. Should the principal opening 206 become blocked by granular material 142, air is free to pass from the principal tubular member 192 through the lateral tubular member 198 and into the secondary tubular member 200 for discharge from the secondary opening 204. Thus, should a blockage of the principal opening 206 occur, the likelihood of the pump 186 overheating and being damaged is minimized.

To prevent the blockages of the principal opening, the bubbler tube 190 may be partially withdrawn from the barrel 184 when granular detergent constituent 142 is added to the barrel 184. To retain the tube 190 in a partially withdrawn condition, a height adjusting ring 208 formed from an elastomeric material is snugly fitted about the member 192 above the slip ring 194. In use, the height adjusting ring 208 may be pushed in a downward fashion as the tube 190 is withdrawn from the barrel 184 to retain the tube 190 at any desired height.

When the adjusting ring 208 is axially-moved back to the top of the member 192 after the powdered detergent constituent 142 has been added to the barrel 184, the tube 190 will slide downwardly through the slip ring 194 until the lateral tubular member 198 rests on top of the undissolved detergent constituent at the tank bottom. Through continued discharge of air through the principal opening 206, the bubbler tube 190 will work its way to the tank bottom as the powdered detergent constituent dissolves.

A float-actuated valve 210, of the type employed in water closets, is provided to the barrel 184 to maintain a predetermined liquid level therein. The valve 210, is suspended from the tank lid 196 by a rigid, J-shaped conduit 212 in fluid communication with a pressurized water source. A manually-operated valve 214 is provided for selectively isolating the float-actuated valve 210 and, hence, barrel 184, from a water source. A screen assembly 216 is located adjacent the inlet of the manually-operated valve 214 to prevent the entry of debris into the barrel 184.

A conduit 218 having a foot valve 220 at its inlet passes through the lid 196 to permit liquid to be withdrawn from the barrel 184. When liquid level, as sensed by the float 222, is lowered a sufficient amount, the valve 210 will open and water from municipal source 224 will be discharged into the barrel 184 through outlet 226. Simultaneously, a secondary discharge of water from valve 210 is provided to the top of the bubbler tube 190 through a flexible conduit 228. A check valve 230 is provided in conduit 228 for preventing air passage from the tube 190 to the valve 210.

Water flowing through the bubbler tube 190 abates the build-up of detergent constituent adjacent the openings 204 and 206 where it tends to collect and dry into a solid mass. Water from the conduit 228 redissolves the dried detergent constituent and permits it to be "blown" from the bubbler tube 190. Without the periodic flow of water through the tube 190, the passage of air through the openings 204 and 206 could be reduced to the point where effective circulation of the barrel contents would not occur.

In the operation of the apparatus 10 illustrated in the drawings to produce a liquid solution fully saturated with an inorganic detergent constituent, it is first necessary to add water to the dissolution tank 18 so that the barrel 118 is approximately ⅔ full. Next, enough inorganic detergent constituent 142, in powdered, granular, pelletized or lumped form, is poured into the barrel 118 through the open door portion 128 to raise the fluid level 140 to a point within its operating range. This quantity of inorganic material has been found to be sufficient to supply a typical car wash for several days.

To assist in achieving a highly concentrated or saturated detergent constituent solution in the barrel 118, the motor 158 is energized by engaging the plug 166 of the electrical lead 164 with an electrical current source such as timer 150. Under the influence of the propeller 162, the liquid within the barrel 118 will begin to slowly rotate above the granular material 142.

Although some saltation of individual grains may occur at the interface between the granular material and the rotating liquid above, no bedload movement of the granular material is required to rapidly obtain the desired condition wherein the water can dissolve no more granular material without a change in temperature. Likewise, the suspension of granular solids within the solution by rapid agitation thereof has not been found to greatly increase the rate of dissolution of the granular material.

It should be noted that the saturated concentration of inorganic material in water is a constant when variables such as: temperature, water quality, and chemical composition of the inorganic material are held steady. The usual installation of the invention in an urban environment offers both building structures to shield the apparatus from temperature extremes and municipal water sources of relatively uniform quality. Since these "variable" conditions are, in fact, static in most applications where the instant invention will be employed, a liquid having a known concentration of inorganic detergent constituent can be continuously produced by the dissolution tank 18 from a granular or powdered solid material mixed with water.

As the saturated solution flows from the dissolution tank 18 through a conduit 74 toward the low pressure area created within an eductor 62, the float valve 136 allows fresh water to enter the barrel 118. Any undissolved inorganic material 142 that remains in the barrel 118 is slowly depleted as water is added to the barrel 118. If desired, the solenoid valve 144, controlled by timer 150, may be employed to restrict the flow of water from source 56 to the barrel 118 to a period when finished detergent is not being drawn from the mixing tanks 12, 14 and 16, typically during the late evening or early morning.

Under the influence of the rotating propeller 162, the fresh water rapidly mixes with the saturated solution already located within the barrel 118 so as to create a temporary undersaturated condition. The undersaturated liquid, in turn, dissolves additional inorganic material 142 until saturation is reached.

When the fluid level in any one of the mixing tanks 12, 14 or 16 drops below a preset elevation, as happens through the withdrawal of the finished detergent through discharge conduits 25, the inorganic and organic detergent constituents as well as other additives are drawn through the transfer conduits 70 and 74 into the eductors 60 and 62 as water from the float valve 48 is jetted therethrough.

As the pressure drop, or drawdown, induced by the vacuum of the venturi chambers 64 across each of the metering inserts 86 is substantially the same, the relative proportions of the detergent constituents drawn into the eductors 60 and 62 are controlled by simply varying the sizes of orifices 88 in the metering inserts 86.

The liquid detergent constituent in the liquid chemical supply containers 20, 22 and 24 may include, by way of example, one or more surfactants, foamers, wetting agents, couplers, dyes and solvents. By varying the type and proportion of these constituentns combined in the mixing tanks 12, 14 and 16 with the inorganic detergent constituent formed in the dissolution tank 18, finished detergents tailored to a particular application can be mixed in each individual mixing tank. For example, mixing tank 12 could be utilized for presoaking solution, mixing tank 14 for car wash detergent, and mixing tank 16 for tire cleaning solution.

The finished detergent solutions can be retained in the mixing tanks 12, 14 and 16 for withdrawal on an "as needed" basis. Depending upon the application, such may be further diluted with water for high pressure washing or used "as is" for presoaking, washing, engine degreasing, tire cleaning, or other applications.

While the foregoing invention description is particularly directed toward a detergent mixing apparatus and method involving the use of a surfactant, it should be apparent that the apparatus and method can be employed to combine predetermined proportions of any liquid and/or powdered chemical compositions with a pressurized stream of any dilutant liquid.

Relatively dilute hydrofluoric or citric acid mixtures may also be prepared by the above-described apparatus for vehicle washing purposes. Hydrofluoric acid mixtures are excellent aluminum brighteners and are frequently used to clean truck wheels and fuel tanks. Mixtures containing citric acid and a suitable surfactant, on the other hand, are safe when properly handled and are effective in removing hard water scale and carbonaceous "road films" from painted surfaces.

Like most detergents, citric acid must be highly diluted with water to form a stable composition which may be employed for vehicle washing purposes. Delivery of such compositions to a location remote from the point of their manufacture has heretofore been cost prohibitive. The dissolution tank 18 of the present invention, however, permits concentrated citric acid to be formed from its powdered constituent when dissolved in water.

A suitable surfactant may be mixed with the concentrated citric acid in a stream of dilutant water flowing through the venturi assembly. As described hereinabove, metering inserts 86 each having an orifice of predetermined dimensions may be preferably utilized to control the ratio of citric acid to surfactant in the final composition. This composition may be subsequently pumped from a mixing tank to a nozzle for discharge onto a surface desired to be cleaned. A final rinse with an alkaline solution and fresh water renders the surface clean and pH neutral.

Thus, it is to be understood that the present invention is not limited to the several embodiments described above, but encompasses any and all embodiments within the scope and spirit of the following claims.

I claim:

1. A detergent mixing apparatus for use with a pressurized water source, comprising:

a mixing tank;

a pair of liquid chemical supply containers each accommodating a liquid chemical composition;

a first water supply conduit for connecting a pressurized water source with said mixing tank;

a pair of venturi chambers disposed within said first water supply conduit and arranged for parallel flow, each of said venturi chambers having a suction port in fluid communication, respectively, with one of said liquid chemical supply containers for drawing the liquid chemical composition from each said chemical supply containers as pressurized water passes through said venturi chambers and entraining the liquid chemical compositions in the pressurized water; and, a first float-actuated control valve operably connected to said water supply conduit for terminating the flow of water and entrained liquid chemical compositions through said water supply conduit when the liquid level in said mixing tank reaches a first predetermined height.

2. The detergent mixing apparatus according to claim 1 further comprising:

a manifold in said first water supply conduit upstream from said pair of venturi chambers; and, a valve in said manifold adapted to provide a flow of air to said pair of venturi chambers when said first float-actuated control valve is closed.

3. The detergent mixing apparatus according to claim 1 wherein said first float-actuated control valve is connected to said water supply conduit upstream from said venturi chamber.

4. The detergent mixing apparatus according to claim 1 further comprising at least one metering insert serially connected between one of said liquid chemical supply containers and one of said pair of venturi chambers, said metering insert having an orifice of predetermined dimensions for controlling the rate of flow of liquid chemical composition therethrough.

5. The detergent mixing apparatus according to claim 1 wherein one of said pair of liquid chemical supply containers comprises:

a dissolution tank for dissolving powdered chemicals in water, said dissolution tank having an opening in its upper end for the admission of the powdered chemicals;

a second water supply conduit for connecting a pressurized water source with said dissolution tank; and, a second float-actuated control valve operably connected to said second water supply conduit for terminating the flow of water from said second water supply conduit into said dissolution tank when the liquid level in said dissolution tank reaches a predetermined height.

6. The detergent mixing apparatus according to claim 5 further comprising a motor-driven propeller positioned within said dissolution tank to aid in dissolving powdered chemical compositions placed therein.

7. The detergent mixing apparatus according to claim 5 further comprising an air supply conduit for connecting a pressurized air source with said dissolution tank so that pressurized air may stir the contents of said dissolution tank, said air supply conduit having a discharge outlet adapted for suspension beneath the top of said dissolution tank.

8. The detergent mixing apparatus according to claim 7 wherein said second float-actuated control valve includes a primary water discharge port open to the interior of said dissolution tank and a secondary water discharge port in fluid communication with said air supply conduit for rinsing said discharge outlet.

9. A detergent mixing apparatus, comprising:

a mixing tank;

a first water supply conduit adapted for connecting a pressurized water source with said mixing tank;

a pair of liquid chemical supply containers each accommodating a liquid chemical, one of said plurality of liquid chemical supply containers being a dissolution tank for dissolving powdered chemicals in water, said dissolution tank having an opening in its upper end for the admission of a powdered chemical composition;

a second water supply conduit adapted for connecting a pressurized water source with said dissolution tank;

a pair of venturi chambers disposed within said first water supply conduit and arranged for parallel flow, each of said venturi chambers having a suction port in fluid communication, respectively, with one of said liquid chemical supply containers for drawing the liquid chemical composition from each said chemical supply containers as pressurized water passes through said venturi chambers and entraining the liquid chemical compositions in the pressurized water; and, a first float-actuated control valve operably connected to said water supply conduit for terminating the flow of water and entrained liquid chemical compositions through said water supply conduit when the liquid level in said mixing tank reaches a first predetermined height.

10. The detergent mixing apparatus according to claim 9 further comprising:

a manifold in said first water supply conduit upstream from said pair of venturi chambers; and, a valve in said manifold adapted to provide a flow of air to said pair of venturi chambers when said first float-actuated control valve is closed.

11. The detergent mixing apparatus according to claim 9 further comprising at least one metering insert serially connected between one of said liquid chemical supply containers and one of said pair of venturi chambers, said metering insert having an orifice of predetermined dimensions for controlling the rate of flow of liquid chemical composition therethrough.

12. The detergent mixing apparatus according to claim 9 further comprising a motor-driven propeller positioned within said dissolution tank to aid in dissolving chemical compositions placed therein.

13. The detergent mixing apparatus according to claim 9 further comprising an air supply conduit for connecting a pressurized air source with said dissolution tank so that pressurized air may stir the contents of said dissolution tank, said air supply conduit having a discharge outlet adapted for suspension beneath the top of said dissolution tank.

14. The detergent mixing apparatus according to claim 13 wherein said second float-actuated control valve includes a primary water discharge port open to the interior of said dissolution tank and a secondary water discharge port in fluid communication with said air supply conduit for rinsing said discharge outlet.

15. A detergent mixing apparatus for use with a pressurized water source, comprising:

a plurality of mixing tanks;

a pair of liquid chemical supply containers each accommodating a liquid chemical;

a plurality of first water supply conduits for connecting a pressurized water source with each of said plurality of mixing tanks;

a plurality of venturi chambers, one of said plurality of venturi chambers disposed within each of said first water supply conduits, each of said venturi chambers having a pair of suction ports in fluid communication, respectively, with one of said pair of liquid chemical supply containers for drawing the liquid chemical from said pair of liquid chemical supply containers as pressurized water passes through said venturi chamber and entraining the liquid chemical in the pressurized water; and, a plurality of first float-actuated control valves, one of said plurality of first float-actuated control valves operably connected to each of said first water supply conduits for terminating the flow of water and entrained liquid chemicals to each one of said mixing tanks when the liquid level in each one of said mixing tanks reaches a first predetermined height.

16. The detergent mixing apparatus according to claim 15 further comprising:

a plurality of manifolds each, respectively, positioned in one of said first water supply conduits upstream from said pair of venturi chambers; and, a plurality of valves each, respectively, positioned in one of said manifolds and adapted to provide a flow of air to said pair of venturi chambers when said first float-actuated control valve is closed.

17. The detergent mixing apparatus according to claim 15 further comprising at least one metering insert serially connected between one of said liquid chemical supply containers and one of said venturi chambers, said metering insert having an orifice of predetermined dimensions for controlling the rate of flow of liquid chemical composition therethrough.

18. The detergent mixing apparatus according to claim 15 wherein one of said pair of liquid chemical supply containers comprises:

a dissolution tank for dissolving powdered chemicals in water, said dissolution tank having an opening in its upper end for the admission of the powdered chemicals;

a second water supply conduit for connecting a pressurized water source with said dissolution tank; and, a second float-actuated control valve operably connected to said second water supply conduit for terminating the flow of water from said second water supply conduit into said dissolution tank when the liquid level in said dissolution tank reaches a predetermined height.

19. The detergent mixing apparatus according to claim 15 further comprising a motor-driven propeller positioned within said dissolution tank to aid in dissolving chemical compositions placed therein.

20. The detergent mixing apparatus according to claim 15 further comprising an air supply conduit for connecting a pressurized air source with said dissolution tank so that pressurized air may stir the contents of said dissolution tank, said air supply conduit having a discharge outlet adapted for suspension beneath the top of said dissolution tank.

* * * * *